US008944561B2

(12) United States Patent
Sugiura et al.

(10) Patent No.: US 8,944,561 B2
(45) Date of Patent: Feb. 3, 2015

(54) LIQUID EJECTION APPARATUS

(71) Applicants: Keita Sugiura, Nagoya (JP); Shingo Hattori, Nagoya (JP)

(72) Inventors: Keita Sugiura, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,022

(22) Filed: Mar. 26, 2013

(65) Prior Publication Data

US 2014/0063117 A1 Mar. 6, 2014

(30) Foreign Application Priority Data

Aug. 31, 2012 (JP) ..... 2012-191963

(51) Int. Cl.
*B41J 2/165* (2006.01)

(52) U.S. Cl.
CPC ..... *B41J 2/165* (2013.01); *B41J 2/16505* (2013.01); *B41J 2/16552* (2013.01); *B41J 2002/16555* (2013.01)
USPC ..... 347/29

(58) Field of Classification Search
CPC .. B41J 2/165; B41J 2002/165; B41J 2/16505; B41J 2002/16514; B41J 2002/16555; B41J 2/08; B41J 2/16517; B41J 2/18
USPC ..... 347/29, 34, 25
See application file for complete search history.

(56) References Cited

U.S. PATENT DOCUMENTS

| | | | | |
|---|---|---|---|---|
| 6,151,043 | A * | 11/2000 | Michael et al. | 347/29 |
| 6,203,136 | B1 * | 3/2001 | Takahashi et al. | 347/32 |
| 6,290,323 | B1 | 9/2001 | Sharma et al. | |
| 6,312,092 | B1 | 11/2001 | Usui et al. | |
| 7,806,517 | B2 | 10/2010 | Muraoka | |
| 8,272,708 | B2 | 9/2012 | Silverbrook et al. | |
| 2007/0206047 | A1 | 9/2007 | Matsuda | |

(Continued)

FOREIGN PATENT DOCUMENTS

| | | | |
|---|---|---|---|
| EP | 2371549 | A1 | 10/2011 |
| GB | 2280149 | A | 1/1995 |

(Continued)

OTHER PUBLICATIONS

United States Patent and Trademark Office, Non Final Office Action for U.S. Appl No. 13/356,531, mailed Aug. 18, 2014.

(Continued)

*Primary Examiner* — Matthew Luu
*Assistant Examiner* — Patrick King
(74) *Attorney, Agent, or Firm* — Baker Botts L.L.P.

(57) ABSTRACT

A liquid ejection apparatus includes: a head having an ejection face; a capping mechanism including: a separator having a lip member enclosing the head; a facing member facing the ejection face to form an ejection space; and a moving mechanism for moving the lip member between a contact position and a distant position; and a humidifying mechanism including: a humid air producer; a first projecting portion extending along a first side face of the head and extending in a direction away from the first side face; a supply opening defined by the first projecting portion and the separator, for supplying humid air into the ejection space; and an air discharger disposed on an opposite side of the ejection face from the supply opening and configured to discharge air from the ejection space. At least one cutout is formed in an edge portion of the first projecting portion.

12 Claims, 9 Drawing Sheets

(56) References Cited

U.S. PATENT DOCUMENTS

| | | | | |
|---|---|---|---|---|
| 2007/0229581 | A1* | 10/2007 | Taira et al. | 347/29 |
| 2007/0229611 | A1 | 10/2007 | Nagashima | |
| 2007/0257957 | A1* | 11/2007 | Takagi | 347/29 |
| 2008/0284814 | A1* | 11/2008 | Chikamoto et al. | 347/29 |
| 2011/0242204 | A1 | 10/2011 | Shinoda | |
| 2012/0206537 | A1* | 8/2012 | Nukui et al. | 347/32 |
| 2013/0241992 | A1* | 9/2013 | Shimizu et al. | 347/29 |

FOREIGN PATENT DOCUMENTS

| | | | |
|---|---|---|---|
| JP | S64-005852 | A | 1/1989 |
| JP | H02-192951 | A | 7/1990 |
| JP | H03-184852 | A | 8/1991 |
| JP | H09-085959 | A | 3/1997 |
| JP | H10-264402 | A | 10/1998 |
| JP | 2000-079696 | A | 3/2000 |
| JP | 2002-127440 | A | 5/2002 |
| JP | 2003-165230 | A | 6/2003 |
| JP | 2005-212138 | A | 8/2005 |
| JP | 2005-271314 | A | 10/2005 |
| JP | 2007-230137 | A | 9/2007 |
| JP | 2008-030357 | A | 2/2008 |
| JP | 2011-207091 | A | 10/2011 |
| JP | 2012-166368 | A | 9/2012 |

OTHER PUBLICATIONS

United States Patent and Trademark Office, Final Office Action for U.S. Appl. No. 13/356,531, mailed Jul. 17, 2013.

European Patent Office, extended European Search Report for European Patent Application No. 11000955.2, dated Aug. 11, 2011.

Japan Patent Office, Notification of Reasons for Refusal for Japanese Patent Application No. 2007-077747, dispatched Jul. 24, 2012.

Japan Patent Office, Decision of Refusal for Japanese Patent Application No. 2010-077747, dispatched Oct. 16, 2012.

United States Patent and Trademark Office, Non Final Office Action for U.S. Appl. No. 13/356,531, mailed Apr. 5, 2013.

European Patent Office, extended European Search Report for European Patent Application No. 12151356.8, dated May 18, 2012.

The State Intellectual Property Office of the People's Republic of China, Notification of First Office Action for Chinese Patent Application No. 201110048527.8, issued Apr. 3, 2013.

United States Patent and Trademark Office, Non Final Office Action for U.S. Appl. No. 14/016,043, mailed Oct. 3, 2014.

* cited by examiner

LIQUID EJECTION APPARATUS

CROSS REFERENCE TO RELATED APPLICATION

The present application claims priority from Japanese Patent Application No. 2012-191963, which was filed on Aug. 31, 2012, the disclosure of which is herein incorporated by reference in its entirety.

BACKGROUND OF THE INVENTION

1. Field of the Invention

The present invention relates to a liquid ejection apparatus configured to eject liquid.

2. Description of the Related Art

There is known a liquid ejection apparatus including a head having an ejection face in which a multiplicity of ejection openings are formed for ejecting liquid such as ink. When the liquid has not been ejected from the ejection openings for a long time, viscosity of liquid near the ejection openings increases due to vaporization of water of the liquid, causing clogging of the ejection openings. There is known the following liquid ejection apparatus for avoiding the clogging of the ejection openings, for example.

In this apparatus, an ejection face is covered with a recessed capping unit to form an ejection space isolated from an outside space. This apparatus includes an air conditioner having an air channel whose air inlet and air outlet are formed in a bottom face of the capping unit. Humid air is supplied from the air inlet into the ejection space, and air in the ejection space is discharged from the air outlet, so that liquid near the ejection openings is humidified. This humidification suppresses vaporization of the liquid being near the ejection openings and prevents the clogging of the ejection openings.

SUMMARY OF THE INVENTION

In this apparatus, however, the air inlet and the air outlet are not formed in opposite ends of the bottom face of the capping unit. That is, though a humidification path is formed in the ejection space such that the humid air flows from the air inlet to the air outlet via the ejection face, the humidification path does not extend to the ends of the capping unit. That is, it is difficult for the humid air to flow along an enclosing member (i.e., a separator) of the capping unit which is capable of contacting the ejection face. This design does not allow the humid air to humidify liquid adhering to the enclosing member. Thus, when the circulation of the humid air is stopped, water of the liquid near the ejection openings is absorbed by non-humidified high-viscosity liquid remaining on the enclosing member and its vicinities. As a result, viscosity of the liquid near the ejection openings increases, causing the clogging of the ejection openings.

This invention has been developed to provide a liquid ejection apparatus capable of reducing an increase in viscosity of liquid remaining on a separator and its vicinities.

The present invention provides a liquid ejection apparatus, comprising: a head comprising an ejection face and configured to eject liquid through a plurality of ejection openings formed in the ejection face; a capping mechanism comprising: a separator provided on the head and comprising a lip member enclosing the head; a facing member facing the ejection face to form an ejection space therebetween; and a lip-member moving mechanism configured to move the lip member between a contact position where the lip member is held in contact with the facing member and a distant position where the lip member is spaced apart from the facing member, the capping mechanism being configured to switch the ejection space between (i) a closed state in which the separator separates the ejection space and an outside space and (ii) an open state in which the ejection space is open to the outside space; a humidifying mechanism comprising: a humid air producer configured to produce humid air; a first projecting portion extending along a first side face of the head and extending in a direction away from the first side face; a supply opening defined by the first projecting portion and the separator, wherein the humid air produced by the humid air producer is supplied into the ejection space through the supply opening; and an air discharger disposed on an opposite side of the ejection face from the supply opening and configured to discharge air from the ejection space; and a controller configured to control the lip-member moving mechanism and the humidifying mechanism, wherein at least one cutout is formed in an edge portion of the first projecting portion.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings.

Figure 1:
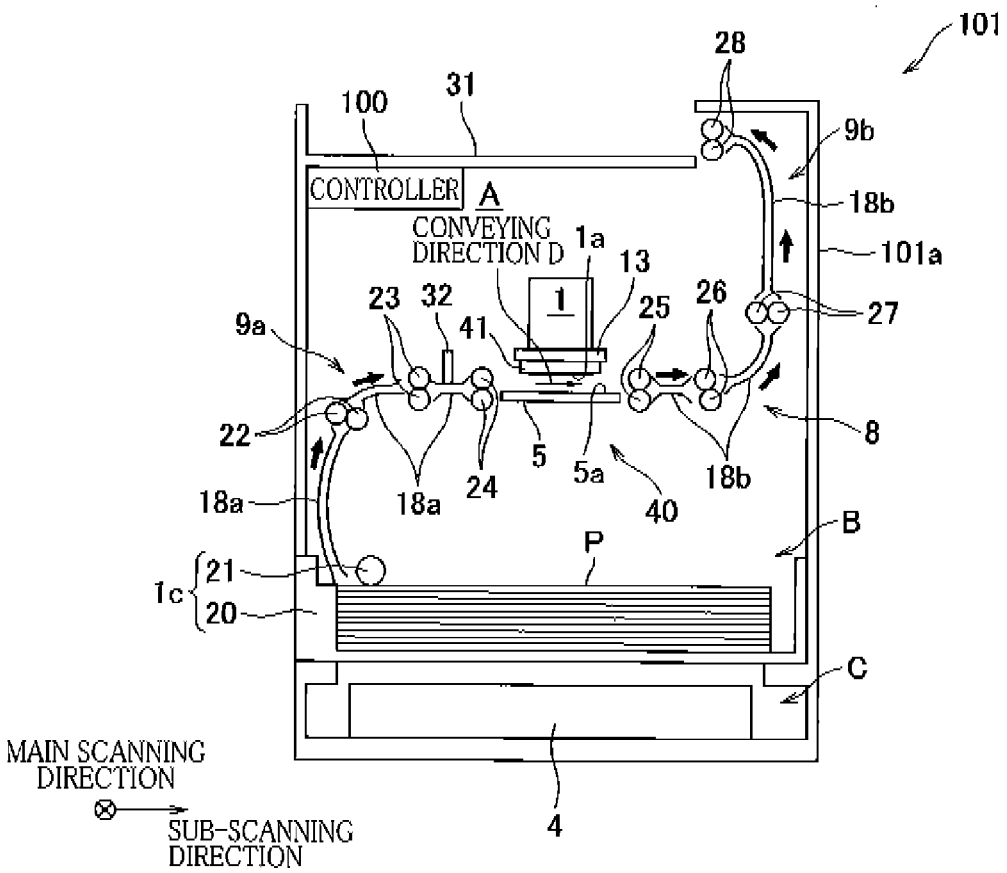
FIG. 1 is a side view generally illustrating an internal structure of an ink-jet printer as one example of a liquid ejection apparatus according to one embodiment of the present invention.

First, there will be explained, with reference to FIG. 1, an overall structure of an ink jet printer 101 as one example of a liquid ejection apparatus according to one embodiment of the present invention.

The printer 101 includes a housing 101*a* having a rectangular parallelepiped shape. A sheet-output portion 31 is provided on a top plate of the housing 101*a*. An inner space of the housing 101*a* can be divided into spaces A, B, C in order from an upper side thereof. Formed in the spaces A, B is a sheet conveyance path that extends from a sheet-supply portion 1*c* to the sheet-output portion 31. A recording medium in the form of a sheet P is conveyed through this sheet conveyance path along bold arrows illustrated in FIG. 1. In the space A, image recording on the sheet P and the conveyance of the sheet P to the sheet-output portion 31 are performed. In the space B, the sheet P is supplied to the conveyance path. Mounted in the space C is a cartridge 4 from which ink is supplied to a head 1 provided in the space A.

Devices and components provided in the space A include: the head 1 configured to eject black ink; a conveyor mechanism 8; a cap mechanism 40; a sheet sensor 32; a humidifying mechanism 50 (see FIG. 4) used for a humidifying operation; and a controller 100.

The head 1 has a generally rectangular parallelepiped shape elongated in a main scanning direction. The head 1 is configured to form or record an image on the basis of a drive signal. The head 1 is supported by the housing 101*a* via a head holder 13 and opposed to the platen 5 with a predetermined space therebetween. The head 1 is a stacked body including a head main body 3 (see FIG. 2), a reservoir unit 12 (see FIG. 5), a flexible printed circuit (FPC), and a circuit board. Formed in the reservoir unit 12 as an upstream channel member is an upstream ink channel, not shown, having a reservoir, not shown. The ink is supplied from the cartridge 4 to this upstream ink channel. The reservoir is for temporarily storing the ink.

The head main body 3 includes actuator units 19 and a channel unit 11 as a downstream channel member, and the ink in the reservoir unit 12 is supplied into this channel unit 11. A lower face of the channel unit 11 is an ejection face 1*a* having a multiplicity of ejection openings 108 formed therein. The ink is ejected from these ejection openings 108 by drivings of the actuator units 19. It is noted that the head 1 is explained later in detail.

The circuit board adjusts signals received from the controller 100. The output signal is converted by a driver IC provided on the FPC, to a drive signal that is output to the actuator unit 19 of the head main body 3. When the drive signal is supplied to the actuator unit 19, this actuator unit 19 is deformed to apply a pressure to the ink in the channel unit 11.

In addition to the head 1, a cap 41 (as one example of a separator) of the cap mechanism 40 is mounted on the head holder 13. This cap 41 is provided on the head 1 so as to enclose the head 1 in plan view. The cap mechanism 40 will be explained later in detail.

The conveyor mechanism 8 includes the platen 5 and two guide portions 9*a*, 9*b* for guiding the sheet P. The two guide portions 9*a*, 9*b* are respectively arranged on opposite sides of the platen 5. The upstream guide portion 9*a* in the conveying direction includes three guides 18*a* and three conveyor roller pairs 22-24 and connects between the sheet-supply portion 1*c* and the platen 5. The sheet P for image recording is conveyed toward the platen 5 while guided by this upstream guide portion 9*a*. The downstream guide portion 9*b* in the conveying direction includes three guides 18*b* and four conveyor roller pairs 25-28 and connects between the platen 5 and the sheet-output portion 31. After the image recording, the sheet P is conveyed toward the sheet-output portion 31. It is noted that the platen 5 is a plate-like member that is one size larger in plan view than each of the ejection face 1*a* and the cap 41.

The sheet sensor 32 is disposed upstream of the conveyor roller pair 24 in the conveying direction to sense a leading edge of the sheet P. Upon sensing the sheet P, the sheet sensor 32 outputs a sense signal that is used for driving the head 1 and the conveyor mechanism 8 in accordance with each other, enabling image recording at desired resolution and speed.

The humidifying mechanism 50 is configured to supply humid air into an ejection space S1 that is opposed to the ejection face 1*a*. In this supply, ink in the ejection openings 108 exposed to the ejection space S1 is replenished with water to reduce an increase in viscosity of the ink and suppress drying.

The sheet-supply portion 1*c* is disposed in the space B. The sheet-supply portion 1*c* includes: a sheet-supply tray 20 and the sheet-supply roller 21. The sheet-supply fray 20 is removably mounted on the housing 101*a*. The sheet-supply tray 20 can accommodate a plurality of sheets P. The sheet-supply roller 21 supplies an uppermost one of the sheets P on the sheet-supply tray 20.

Here, a sub-scanning direction is a direction parallel to the conveying direction D (indicated by arrow D in FIG. 1) in which the sheet P is conveyed by the conveyor roller pairs 23-25, and the main scanning direction is a direction parallel to a horizontal plane and perpendicular to the sub-scanning direction.

In the space C, the cartridge 4 storing the black ink is removably mounted on the housing 101*a*. The cartridge 4 is coupled to the head 1 by a tube, not shown, and a pump 29 (see FIG. 7). It is noted that the pump 29 is driven in forcible delivery of the ink to the head 1 (e.g., in purging and initial supply of the liquid) and stopped in the other situations so as not to inhibit the ink supply to the head 1.

There will be next explained the controller 100. The controller 100 controls devices and components of the printer 101 to control operations of the printer 101. The controller 100 controls an image forming operation on the basis of a recording command (including image data) supplied from an external device such as a personal computer (PC) coupled to the printer 101. Upon receiving the recording command, the controller 100 drives devices such as a sheet-supply motor 138 (see FIG. 7) for the sheet-supply roller 21 and a conveyance motor 137 (see FIG. 7) for the conveyor roller pairs 22-28. The sheet P supplied from the sheet-supply tray 20 is guided by the upstream guide portion 9*a* and conveyed onto a support face 5*a* of the platen 5. When the sheet P is conveyed through a position just under the head 1 in the sub-scanning direction (i.e., the conveying direction D), the controller 100 controls the head 1 to eject the ink from the ejection face 1*a* onto the sheet P, so that a desired image is formed on the sheet P. It is noted that the ink ejection is based on the sense signal output from the sheet sensor 32. The sheet P with the image formed thereon is guided by the downstream guide portion 9*b* and discharged from an upper portion of the housing 101*a* onto the sheet-output portion 31.

The controller 100 also controls devices of the printer 101 to perform a maintenance operation to recover and/or maintain the ink ejection characteristics of the head 1 and prepare image recording. The maintenance operation includes: an ink discharge operation such as the purging and flushing; a cleaning operation for cleaning the ejection face 1*a* such as wiping; and an operation for preventing the increase in viscosity of the ink such as the capping and the humidifying operation.

In the purging, the pump 29 is driven to forcibly discharge the ink from all the ejection openings 108. In the flushing, at least one actuator is driven to eject the ink from a corresponding one or ones of the ejection openings 108. The ink ejection in the flushing is based on flushing data that differs from the image data. In the wiping, the ejection face 1*a* is wiped by an elastic plate-like member in the form of a wiper. The wiping is performed after the purging to remove residual ink and foreign matters from the ejection face 1*a*.

Figure 4:
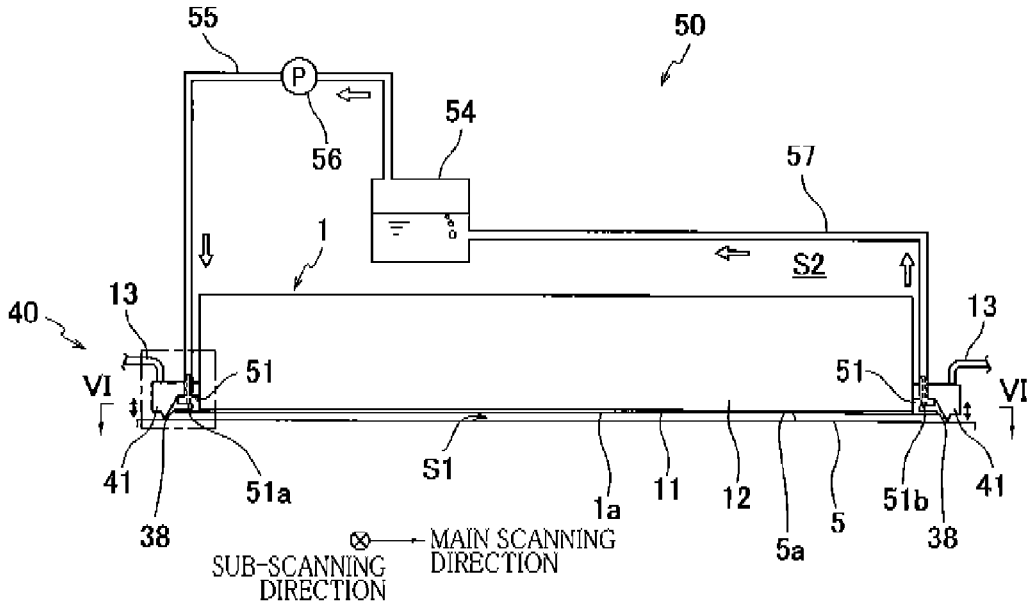
FIG. 4 is a schematic view illustrating a head holder and a humidifying mechanism in the printer illustrated in FIG. 1.
Figure 5A:
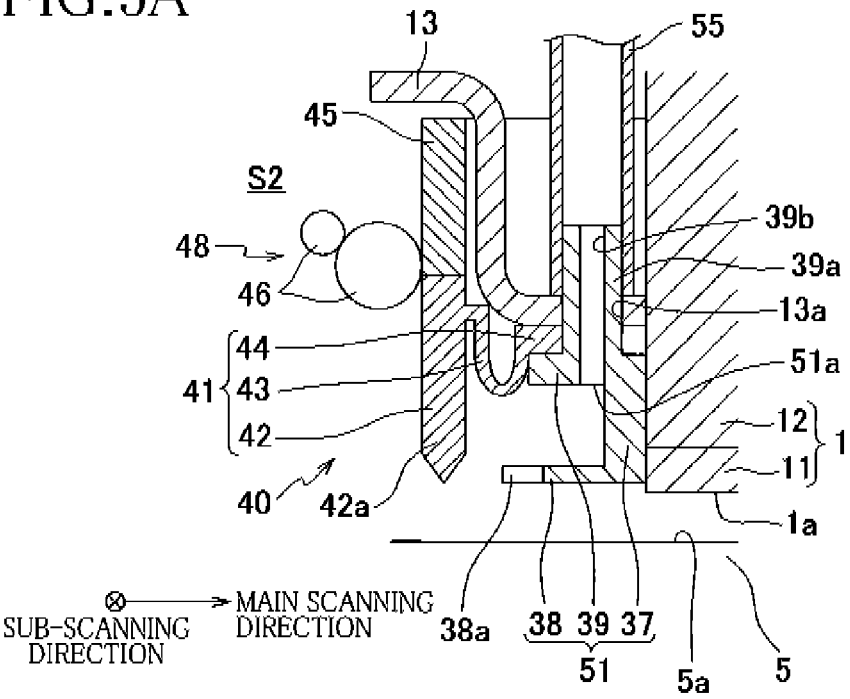
FIG. 5A is a partial cross-sectional view illustrating an area enclosed by one-dot chain lines in FIG. 4 and illustrating a situation in which a cap is located at a distant position.
Figure 5B:
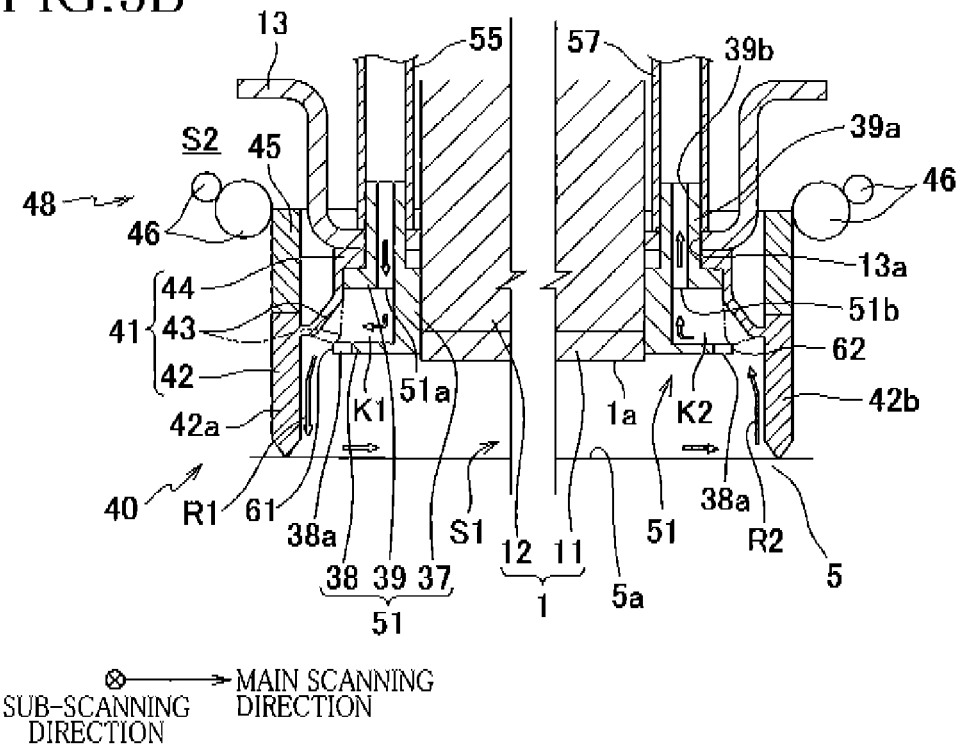
FIG. 5B is a view illustrating a situation in which the cap is located at a contact position.

In the capping, as illustrated in FIGS. 4 and 5B, the cap 41 separates the ejection space S1 and an outside space S2 such that the ejection space S1 is substantially isolated from the outside space S2. In the humidifying operation as the operation for preventing the increase in viscosity of the ink, as illustrated in FIG. 5B, humid air is supplied into the isolated ejection space S1.

The ink discharge operation is performed to discharge foreign matters from the inside of the head 1. The cleaning operation is performed after this ink discharge operation to remove high-viscosity ink being near the ejection openings 108. These operations recover ejection characteristics of the ejection openings 108 and clean the ejection face 1*a*. The capping suppresses drying of ink meniscuses, and the humidification further suppresses the drying. It is noted that the ink discharge operation is performed in various situations, for example, performed just after the printer 101 is turned on, when paper jam occurs in the conveyance path, after the image recording continued for equal to or longer than a predetermined length of time, or after the ejection has not been performed for equal to or longer than a predetermined length of time. The ink discharge operation (especially the flushing) just after the printer 101 is turned on is a preliminary operation for recording. The operation for preventing the increase in viscosity of the ink is performed when the printer 101 is at rest or not operated, for example.

Figure 2:
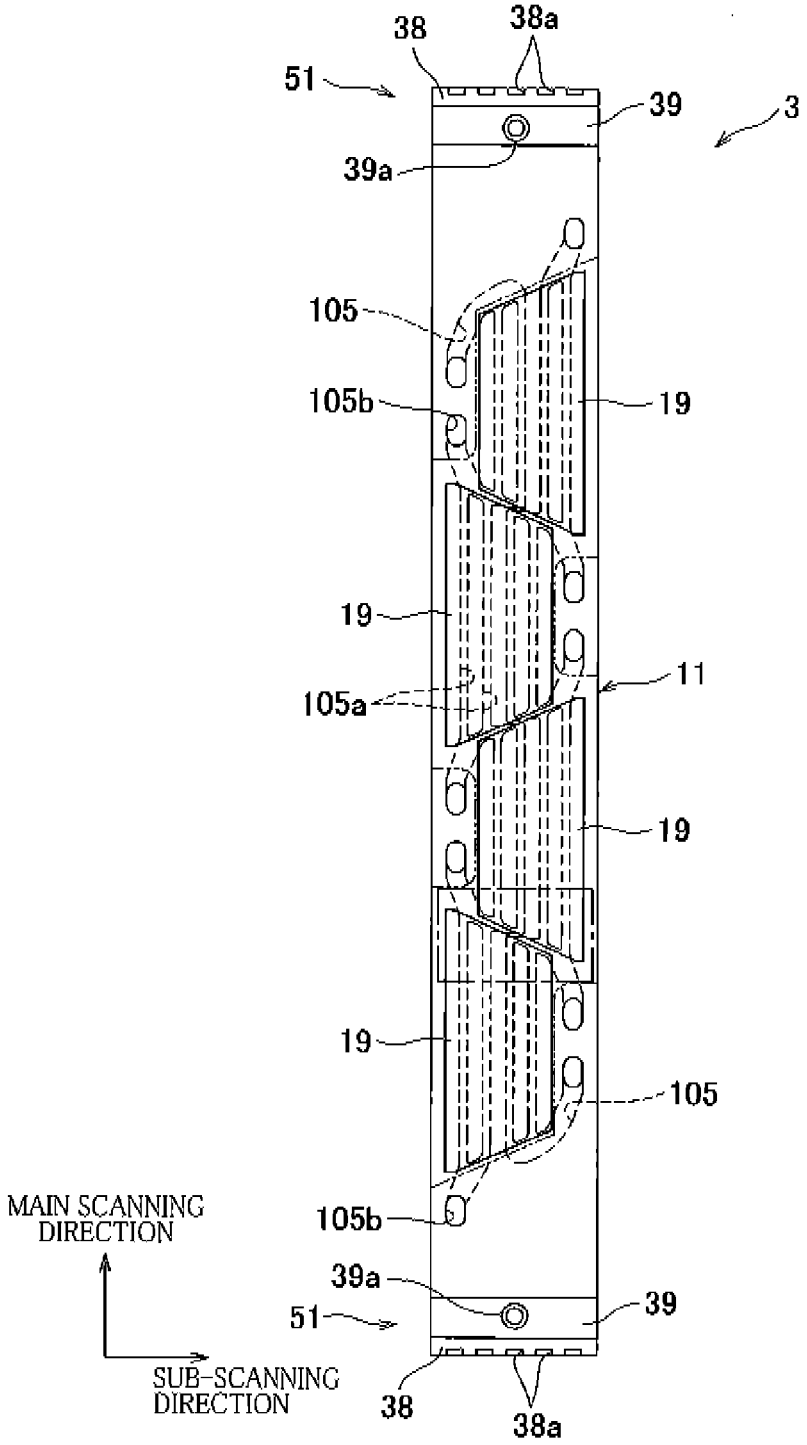
FIG. 2 is a plan view illustrating a head main body of a head and a pair of joint members in the printer illustrated in FIG. 1.
Figure 3A:
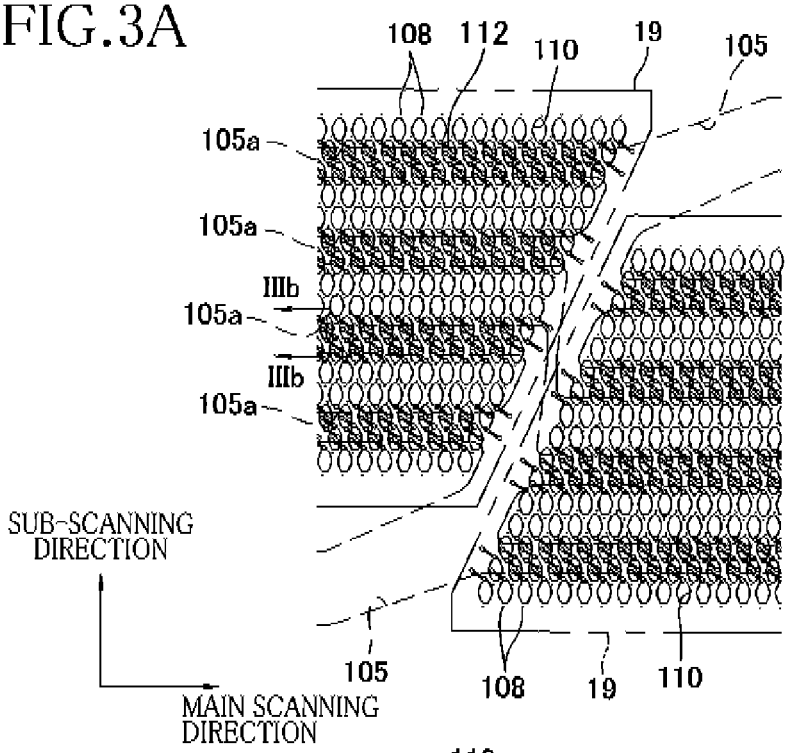
FIG. 3A is an enlarged view illustrating an area enclosed by one-dot chain lines in FIG. 2.

There will be next explained the head main body 3 with reference to FIGS. 2 and 3A-3C. In FIG. 3A, pressure chambers 110, apertures 112, and the ejection openings 108 are illustrated by solid lines for easier understanding purposes though these elements are located under the actuator units 19 and thus should be illustrated by broken lines.

As illustrated in FIG. 2, the head main body 3 is a stacked body including the channel unit 11 and the four actuator units 19 fixed to an upper face of the channel unit 11. The pressure chambers 110 are open in the upper face. The actuator units 19 seal these openings to act as side walls of the respective pressure chambers 110.

Figure 3B:
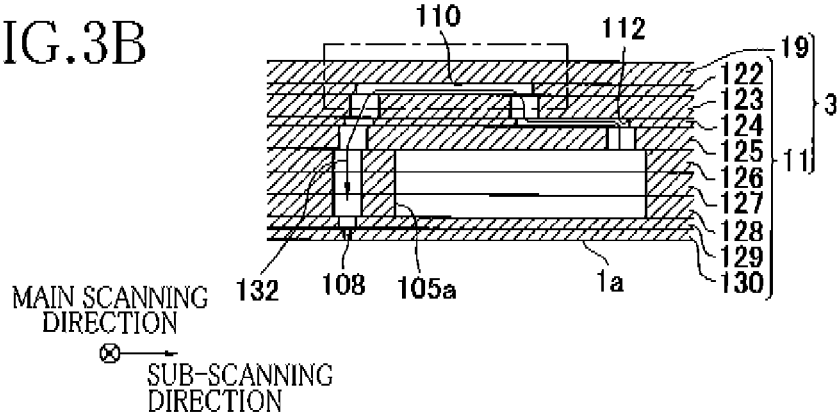
FIG. 3B is a partial cross-sectional view taken along line IIIb-IIIb in FIG. 3A.

As illustrated in FIG. 3B, the channel unit 11 is a stacked body constituted by nine stainless plates 122-130 stacked on one another. Ink channels are formed in the channel unit 11. The ink channels are constituted by upstream common ink channels and downstream individual ink channels 132. The common ink channels are constituted by manifold channels 105 and sub-manifold channels 105*a* each branched off from a corresponding one of the manifold channels 105. Each of the manifold channels 105 has at its one end a corresponding one of ink supply openings 105*b* formed in the upper face. Each of the individual ink channels 132 extends from an outlet of a corresponding one of the sub-manifold channels 105*a* to a corresponding one of the ejection openings 108 formed in a lower face of the channel unit 11, namely the ejection face 1*a*, via a corresponding one of the apertures 112 and a corresponding one of the pressure chambers 110. In the ejection face 1*a*, the ejection openings 108 are arranged in the main scanning direction at pitches corresponding to 600 dpi.

There will be next explained the actuator units 19. As illustrated in FIG. 2, the four actuator units 19 each having a trapezoid shape are arranged in a staggered configuration along the main scanning direction so as not to overlap the ink supply openings 105*b*. Also, parallel sides of each of the actuator units 19 extend in the main scanning direction, and adjacent two oblique lines of the actuator units 19 overlap each other in the sub-scanning direction.

Figure 3C:
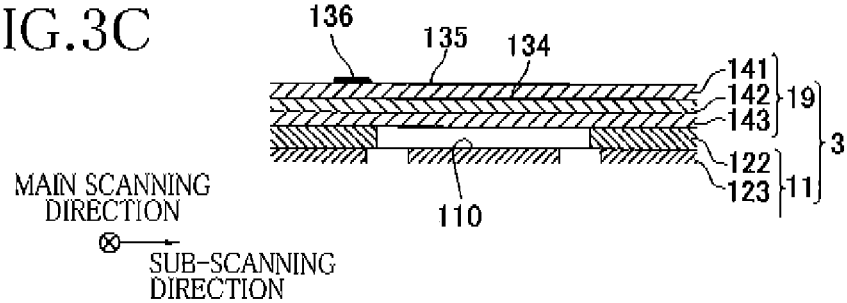
FIG. 3C is an enlarged view illustrating an area enclosed by one-dot chain lines in FIG. 3B.

As illustrated in FIG. 3C, each of the actuator units 19 is constituted by piezoelectric layers 141-143 each formed of a ceramic material of lead zirconate titanate (PZT) having ferroelectricity. A multiplicity of individual electrodes 135 are disposed on an upper face of the uppermost piezoelectric layer 141 that is polarized in its thickness direction. A common electrode 134 is disposed generally entirely on an upper face of the piezoelectric layer 142. When an electric field is applied between the electrodes 134, 135 in the polarization direction, the piezoelectric layer 141 as an active portion is contracted in a planar direction. The piezoelectric layers 142, 143 are not deformed actively, which causes difference in amount of deformation between the piezoelectric layer 141 and the piezoelectric layers 142, 143. As a result, a portion of the piezoelectric layers which is sandwiched between the individual electrode 135 and the pressure chamber 110 projects toward the pressure chamber 110 (noted that this projection is called unimorph deformation). The ink in the pressure chamber 110 is pressurized by this deformation and ejected as an ink droplet.

In view of the above, the actuator units 19 include the plurality of actuators for the respective individual electrodes 135, enabling ejection energy to be individually applied to the ink. Here, the common electrode 134 is always kept at ground potential. Also, the drive signal is selectively supplied from each of individual lands 136 to a corresponding one of the individual electrodes 135. The individual land 136 is provided on a distal end portion of the individual electrode 135.

The present embodiment adopts what is called a fill-before-fire method for the ink ejection. Each individual electrode 135 is set at a predetermined electric potential in advance, keeping the unimorph deformation of the actuator. When the drive signal is supplied, the electric potential of the individual electrode 135 is temporarily made equal to that of the common electrode 134, and, after a predetermined length of time, returned to the predetermined electric potential. At the timing when the electric potential is returned to the predetermined electric potential, the actuator terminates the unimorph deformation, so that the ink is sucked to the pressure chamber 110. Then, at the timing when the electric potential is returned to the predetermined electric potential, the actuator makes the unimorph deformation again, which ejects the ink droplet from the ejection opening 108.

There will be next explained the head holder 13 and the cap mechanism 40 with reference to FIGS. 4, 5A, and 5B.

The head holder 13 is a rigid-body frame formed of metal, for example and supports side faces of the head 1 in its entire perimeter. Contact portions of the head holder 13 and the head 1 are sealed with a sealant in their entire perimeter.

The cap 41 of the cap mechanism 40 is mounted on the head holder 13. Contact portions of the head holder 13 and the cap 41 are fixed to each other with an adhesive in their entire perimeter. The head holder 13 has through holes 13*a* in which connecting portions 39*a* of a pair of joint members 51 which will be described below are respectively fitted. Each of the through holes 13*a* is one size larger than a corresponding one of the connecting portions 39*a*, and a space between the through hole 13*a* and the connecting portion 39*a* is filled with a sealant. Thus, when the cap 41 encloses the ejection space S1, the ejection space S1 is reliably isolated from the outside space S2.

The cap mechanism 40 includes the cap 41, a cap elevating and lowering mechanism 48, and the platen 5. The cap 41 includes a lip member 42 and a diaphragm 43 which are formed integrally with each other. Each of the lip member 42 and the diaphragm 43 is formed of an elastic material such as rubber, e.g., butyl rubber.

The lip member 42 encloses the head 1 and the pair of joint members 51. As illustrated in FIG. 5, the lip member 42 tapers downward toward its tip in cross section.

The diaphragm 43 also encloses the head 1 and the pair of joint members 51 and is tensioned between the lip member 42 and the head 1. More specifically, the diaphragm 43 is a flexible thin-layer member whose outer circumferential edge is connected to an inner circumferential face of the lip member 42 and whose inner circumferential edge portion has a close-contact portion 44. As a result, the space between the lip member 42 and the head 1 is closed. Each portion of the close-contact portion 44 which extends in the main scanning direction has: an inner side face held in close contact with a side face of the head 1; and an upper face held in close contact with a lower face of the head holder 13. Each portion of the close-contact portion 44 which extends in the sub-scanning direction has: an upper face held in close contact with the lower face of the head holder 13; and a lower face held in close contact with a corresponding one of the pair of joint members 51. The upper face of the close-contact portion 44 is fixed to the head holder 13 with an adhesive in its entire perimeter. In a closed state which will be described below, an entire lower face of the diaphragm 43 is located over or on an upper side of brim portions 38. This design reliably provides air passages or paths (i.e., a supply opening and a discharge opening) defined by the diaphragm 43 and the brim portions 38, making it possible to suppress generation of bubbles which will be explained below.

Figure 7:
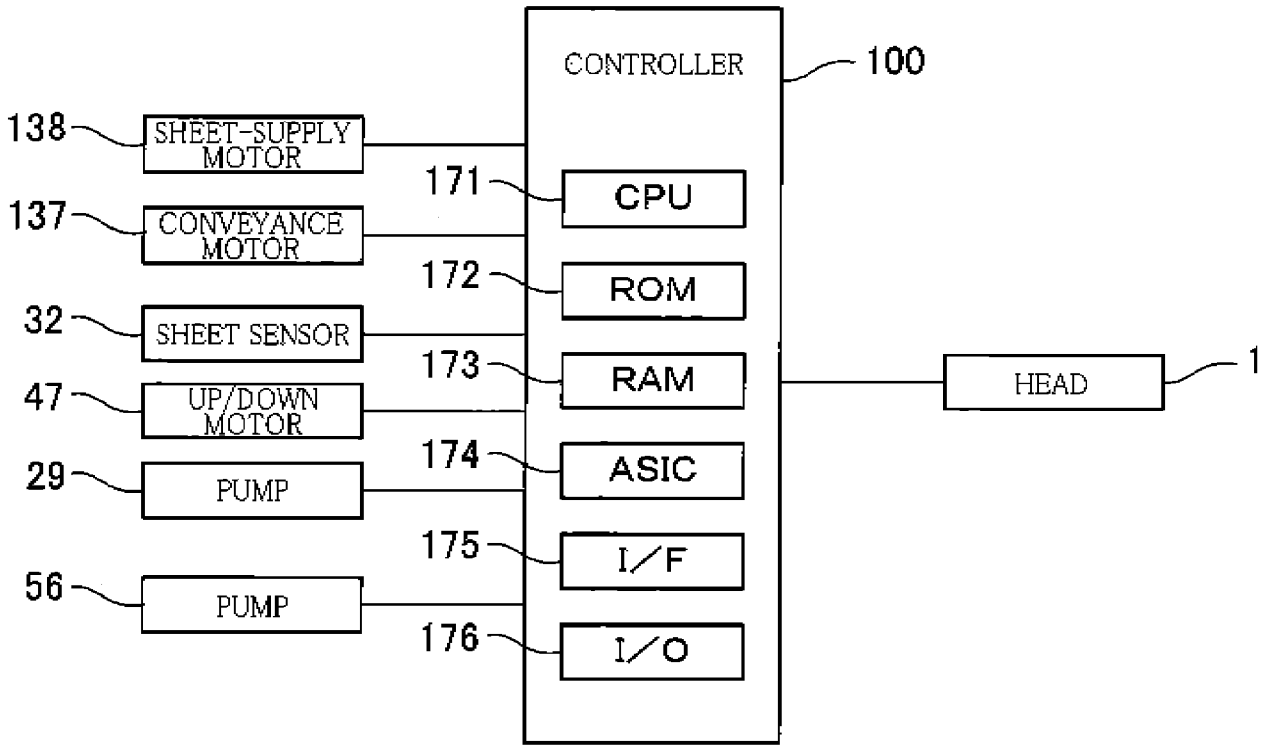
FIG. 7 is a block diagram illustrating an electric configuration of the printer.

The cap elevating and lowering mechanism 48 as one example of a lip-member moving mechanism includes a movable member 45, a plurality of gears 46, and an up/down motor 47 (see FIG. 7). The movable member 45 is formed of a rigid material such as stainless and encloses the head 1 and the pair of joint members 51. A lower face of the movable member 45 is fixed to an upper face of the lip member 42. The movable member 45 is connected to one of the plurality of gears 46. When the controller 100 drives the up/down motor 47, the gears 46 are rotated to selectively elevate or lower the movable member 45. In this movement, the lip member 42 is also elevated or lowered. This movement changes a vertical position of a distal end of the lip member 42 relative to the ejection face 1*a*.

In conjunction with the upward and downward movement of the movable member 45, the lip member 42 is selectively located at one of: a contact position (indicated in FIGS. 4 and 5B) where the distal end of the lip member 42 is held in contact with the support face 5*a* of the platen 5; and a distant position (indicated in FIG. 5A) where the distal end is spaced apart from the support face 5*a*. At the contact position, as illustrated in FIG. 5B, the ejection space S1 is in the closed state or capped state in which the ejection space S1 is substantially isolated from the outside space S2. In this state, the lip member 42 and the diaphragm 43 are spaced apart from each of the pair of joint members 51 (specifically, a distal end of each of the brim portions 38) with a predetermined space therebetween. At the distant position, as illustrated in FIG. 5A, the ejection space S1 is in an open state in which the ejection space S1 is open to the outside space S2. In this state, the diaphragm 43 is bent into a U-shape is greatly distant from the distal ends of the brim portions 38.

Figure 6:
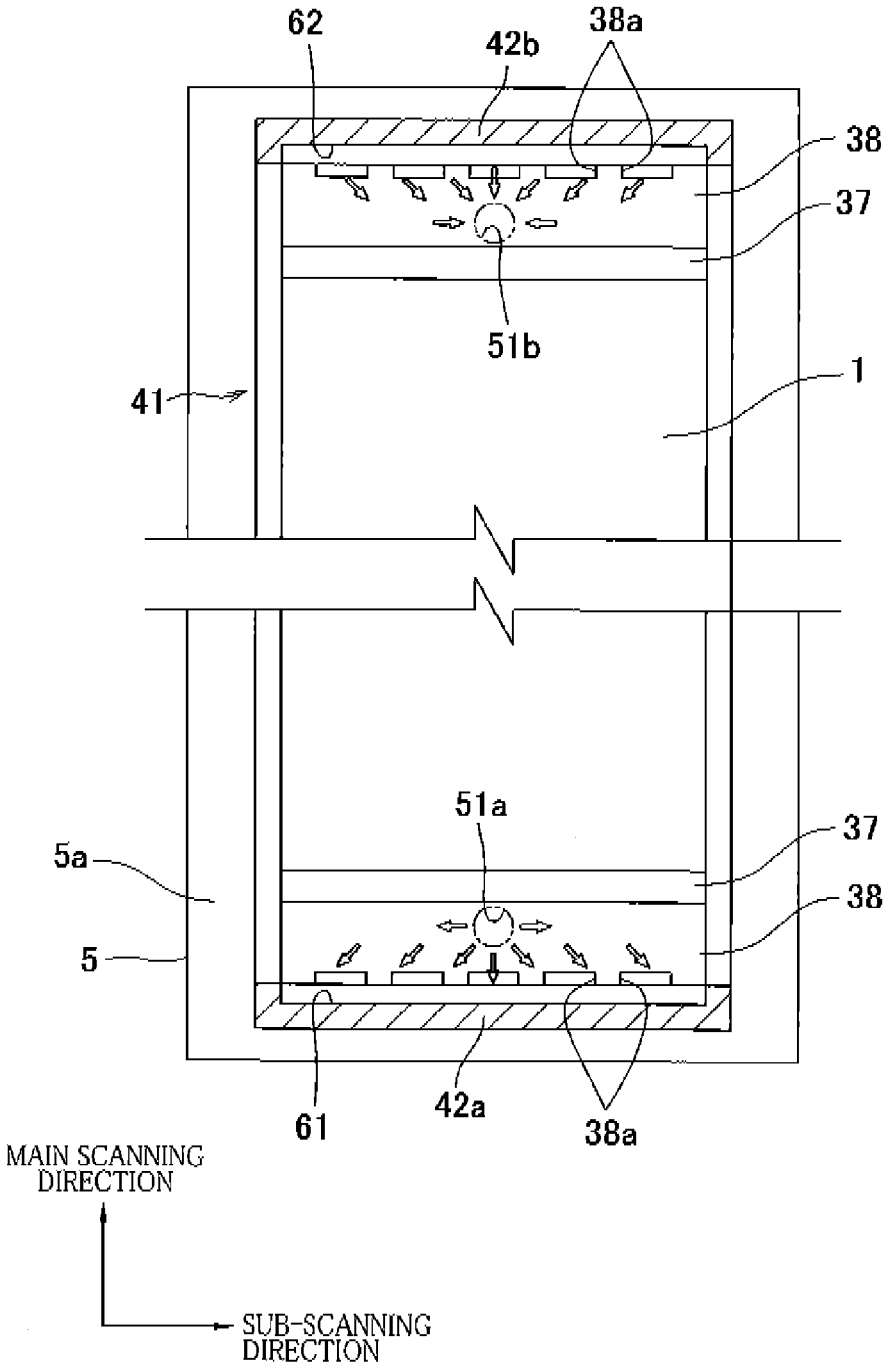
FIG. 6 is a cross-sectional view taken along line VI-VI in FIG. 4.

There will be next explained the humidifying mechanism 50 with reference to FIGS. 4-6.

As illustrated in FIG. 4, the humidifying mechanism 50 includes the pair of joint members 51, tubes 55, 57, a pump 56, and a tank 54. The tube 55 as one example of a first tubular passage has one end connected to the left joint member 51 and the other end connected to the tank 54. The tube 57 as one example of a second tubular passage has one end connected to the right joint member 51 and the other end connected the tank 54. The tubes 55, 57 thus fluidically couple the ejection space S1 and the tank 54 with each other.

The tank 54 as one example of a humid air producer stores at its lower space water for humidification and at its upper space humid air. The tube 57 communicates with the lower space of the tank 54 underwater. The tube 55 communicates with the upper space of the tank 54. Also, the pump 56 is provided on a portion of the tube 55. It is noted that a check valve, not shown, is attached to the tube 57 near the tank 54 to prevent the water from flowing from the tank 54 to the tube 57. Also, when an amount of the water in the tank 54 becomes small, the tank 54 is replenished with water from a water replenishing tank, not shown.

The pair of joint members 51 are fixed to opposite side faces of the head 1 in the main scanning direction, that is, the head 1 is interposed between the pair of joint members 51 in the main scanning direction. Specifically, as illustrated in FIG. 5B, the joint member 51 as one example of an air supplier is fixed to a left side face of the head 1 as one example of a first side face. The joint member 51 as one example of an air discharger is fixed to a right side face of the head 1 as one example of a second side face. These joint members 51 have the same construction as each other.

The joint members 51 respectively include: fixed portions 37 each as one example of a corresponding one of first and second couplers; and the brim portions 38 each as one example of a corresponding one of first and second projecting portions. Each of the fixed portions 37 has a fixed surface that is perpendicular to the ejection face 1*a* and fixed to a corresponding one of the opposite side faces of the head 1 in the main scanning direction. Each of the brim portions 38 is a projecting portion horizontally expanding outward and connected to a lower end of a corresponding one of the fixed portions 37. A lower face of each of the brim portions 38 is located farther from the platen 5 than the ejection face 1*a* so as not to interfere with the conveyance of the sheet P. As illustrated in FIG. 6, each of the brim portions 38 has five cutouts 38*a* in outer edge portion of the brim portion 38 in the main scanning direction, in other words, the cutouts 38*a* are formed in opposite edge portions of the respective brim portions 38 in the main scanning direction. Each of these five cutouts 38*a* is one example of a portion of the supply opening and a portion of the discharge opening. In each of the brim portions 38, these cutouts 38*a* are arranged in a row in the sub-scanning direction. Each of the cutouts 38*a* has a rectangular shape when seen in a direction perpendicular to the ejection face 1*a*. Each of the cutouts 38*a* is elongated in the sub-scanning direction, i.e., in a direction in which the brim portion 38 extends. In other words, the length of the cutout 38*a* in the sub-scanning direction is longer than that in the main scanning direction. It is noted that, as described above, when the ejection space S1 is in the closed state, the distal end of the brim portion 38 is spaced apart from the lip member 42 and the diaphragm 43 with the predetermined space therebetween. In other words, when the ejection space S1 is in the closed state, a portion of the brim portion 38 between each adjacent two of the five cutouts 38*a* (i.e., the distal end of the brim portion 38) is spaced apart from the lip member 42 and the diaphragm 43. It is noted that, as will be described later, the printer 101 according to the present embodiment is capable of supplying the humid air into the ejection space S1 via the five cutouts 38*a* even when the brim portion 38 is in contact with the lip member 42 and the diaphragm 43. Nevertheless, the brim portion 38 may be in contact with the lip member 42 and the diaphragm 43.

Each of the joint members 51 has a generally three-sided rectangular shape in cross section and includes an upper projecting portion 39. Each, upper projecting portion 39 horizontally extends outward from an upper end of a corresponding one of the fixed portions 37. An amount of the outward projection of the upper projecting portion 39 is smaller than that of the brim portion 38. Each of the connecting portions 39*a* is provided upright on a central portion of an upper face of a corresponding one of the upper projecting portions 39 in the sub-scanning direction. A through hole 39*b* is formed through the connecting portion 39*a* and the upper projecting portion 39 in a vertical direction.

As shown in FIG. 5B, the through hole 39*b* of the left joint member 51 is a channel (as one example of a first channel) that communicates with a space K1 (as one example of a first space) enclosed with the joint member 51 (as one example of the air supplier) and the cap 41. The through hole 39*b* has a lower opening 51*a* that is opposed to an upper face of the brim portion 38 and acts as a humid-air inlet of the ejection space S1. On the other hand, the through hole 39*b* of the right joint member 51 is a channel (as one example of a second channel) that communicates with a space K2 (as one example of a second space) enclosed with the joint member 51 (as one example of the air discharger) and the cap 41. The through hole 39*b* has a lower opening 51*b* that is opposed to an upper face of the brim portion 38 and acts as a humid-air outlet of the ejection space S1.

When the controller 100 drives the pump 56, as shown in FIG. 4, the air in the tank 54 is circulated in a direction indicated by white arrows. The humid air stored in the upper space of the tank 54 is supplied from the opening 51*a* into the ejection, space S1, via the space K1. When the ejection space S1 is in the closed state in this supply, air in the ejection space S1 flows toward the opening 51*b* while replaced with the supplied humid air. Since the tube 57 communicates with the tank 54 underwater, the air in the ejection space S1 is humidified in the tank 54. The produced humid air is supplied into the ejection space S1 during driving of the pump 56. The humidifying operation can be performed with this simple structure of the humidifying mechanism 50. Also, the connection of the tube 57 to the tank 54 enables effective humidification of the air discharged from the ejection space S1.

As illustrated in FIG. 5B, the outer edge portion of one of the brim portions 38 is opposed to a first region 42*a* of the lip member 42 via a narrow space in the form of a crack 61 elongated in the sub-scanning direction, and the outer edge portion of the other of the brim portions 38 is opposed to a second region 42*b* of the lip member 42 via a narrow space in the form of a crack 62 elongated in the sub-scanning direction. The crack 61 (as one example of the portion of the supply opening) fluidically couples the space K1 and the ejection space S1 with each other, allowing the humid air to be supplied into the ejection space S1. The crack 62 (as one example of the portion of the discharge opening) fluidically couples the ejection space S1 and the space K2, allowing the air to be discharged from the ejection space S1. As illustrated in FIG. 6, each of these cracks 61, 62 extends to opposite end portions of a corresponding one of the brim portions 38 in the sub-scanning direction. When the ejection space S1 is in the closed state, the inner circumferential face of the lip member 42 and corner portions of the respective brim portions 38 are held in contact with each other at these opposite end portions. It is noted that the first and second regions 42*a*, 42*b* are hatched in FIG. 6. For example, the first region 42*a* is mainly one of short side portions of the rectangular lip member 42 and includes two corner portions of the short side portion which are connected to long side portions of the rectangular lip member 42. The second region 42*b* is of similar construction to the first region 42*a*. These forms of the cracks 61, 62 allow the humid air to reliably flow along inner circumferential faces of the first region 42*a* and the second region 42*b* as indicated by white arrows in FIG. 5B. This can reduce an increase in viscosity of residual ink on the inner circumferential faces and their vicinities, e.g., contact portions of the lip member 42 and the platen 5.

Next there will be mainly explained air flow in the cap 41. Here, as illustrated in FIG. 5B, a path of the humid air along the inner circumferential face of the first region 42*a* is defined as a first path R1, and a path of the humid air along the inner circumferential face of the second region 42*b* is defined as a second path R2.

Upon driving of the pump 56, the humid air flows into the space K1 via the opening 51*a* as indicated by white arrows in FIG. 5B. The humid air flows from the entire crack 61 into the ejection space S1 along the first path R1 and then flows toward the opening 51*b*. The humid air flowing along the second path R2 is discharged from the opening 51*b* via the crack 62.

In the present embodiment, the cutouts 38*a* are formed in the outer edge portion of each brim portion 38. Even in a case where the inner face of the diaphragm 43 comes into contact with the outer edge portion of the brim portion 38 as indicated by two-dot chain lines in FIG. 5B when the ejection space S1 is switched to the closed state, the first path R1 is reliably formed. Without these cutouts in the brim portion 38, the humid air is supplied into the ejection space S1 from contact portions of the diaphragm 43 and the brim portion 38. If ink remains on these contact portions, the supply of the humid air forms bubbles on the ink. When contacting the ejection face 1*a*, these bubbles may close the ejection openings 108, leading to deterioration of the ink ejection characteristics. In the present embodiment, however, the humid air is supplied into the ejection space S1 via the cutouts 38*a*, preventing the humid air from being supplied via the contact portions. Thus, the generation of the bubbles can be prevented, which prevents the ejection face 1*a* from getting soiled. As a result, the ink ejection characteristics are stabilized.

Also, each of the cutouts 38*a* has the rectangular shape in plan view. Thus, even in the case where the diaphragm 43 comes into contact with the outer edge portion of the brim portion 38 when the ejection space S1 is switched to the closed state, the first path R1 is formed more reliably. Even if the ink enters into the cutouts 38*a* in this state, the ink is retained at corner portions of the cutouts 38*a* by surface tension of the ink. Thus, the ink does not close the entire cutouts 38*a*, resulting in effective suppression of the generation of the bubbles.

Also, each of the cutouts 38*a* has the length in the sub-scanning direction which is longer than that in the main scanning direction. Thus, when the ejection space S1 is switched to the closed state, a film of the ink is not easily formed in the cutouts 38*a*. This is because a distance between each adjacent corner portions of the cutouts 38*a* is relatively large in the sub-scanning direction, and accordingly the inks retained at the corner portions do not easily combine. Thus, a film of the ink covering the entire cutouts 38*a* is not easily formed.

Also, the plurality of the cutouts 38*a* are formed in the present embodiment. Thus, when the ejection space S1 is switched to the closed state, the humid air is supplied into the ejection space S1 via the plurality of cutouts 38*a* even in the case where the diaphragm 43 comes into contact with the outer edge portion of the brim portion 38. That is, the first path R1 can be more reliably formed, thereby further reducing the increase in viscosity of the ink remaining on the lip member 42 and its vicinities. In addition, the plurality of the cutouts 38*a* can further reduce the humid air supplied from the contact portions into the ejection space S1. This can further suppress the generation of the bubbles when the humid air is supplied.

Also, the cutouts 38*a* are formed also in the brim portion 38 of the joint member 51 as the air discharger. Thus, even in a case where the diaphragm 43 comes into contact with the outer edge portion of the brim portion 38 as the second projecting portion when the ejection space S1 is switched to the closed state, the air in the ejection space S1 can be smoothly discharged from the cutouts 38*a*. This design can prevent an increase in a pressure in the ejection space S1, thereby preventing the ink meniscuses formed in the ejection openings 108 from being broken.

There will be next explained an electric configuration of the printer 101 with reference to FIG. 7.

As illustrated in FIG. 7, the controller 100 includes a central processing unit (CPU) 171, a read only memory (ROM) 172, a random access memory (RAM) 173 including a non-transitory RAM, an application specific integrated circuit (ASIC) 174, an interface (VF) 175, and an input/output port (I/O) 176. The ROM 172 stores programs executable by the CPU 171, and various fixed data. The RAM 173 temporarily stores data required in the execution of the programs. The ASIC 174 executes overwriting, sorting, and other similar processings for the image data (for example, a signal processing and an image processing). The I/F 175 transmits and receives data to and from an external device. The I/O 176 inputs and outputs signals of various sensors. The controller 100 is coupled to the motors 135, 137, the sheet sensor 32, the control board of the head 1, the up/down motor 47, the pumps 29, 56, and other devices.

Figure 8:
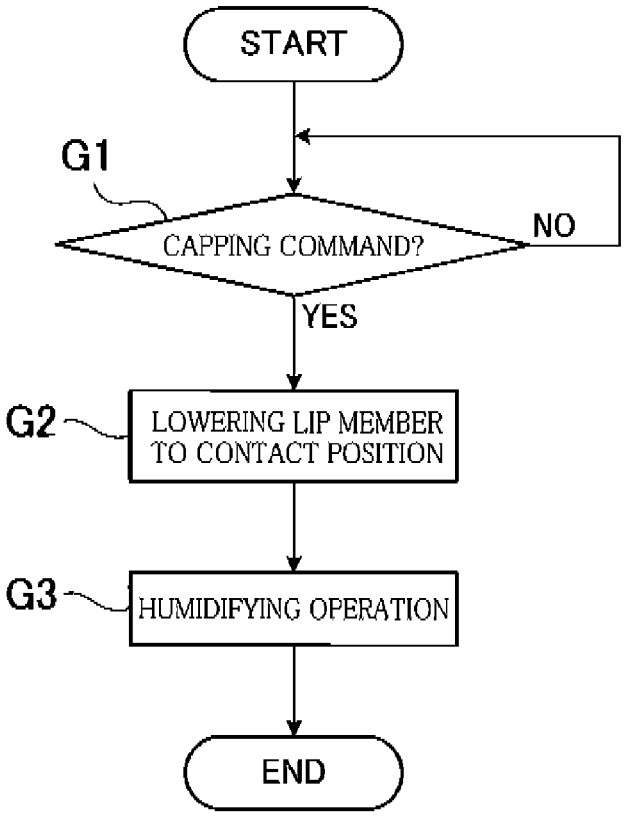
FIG. 8 is a flow chart illustrating processings executed by a controller of the printer to perform capping and a humidifying operation.

There will be next explained, with reference to a flow chart in FIG. 8, controls of the controller 100 for the capping and the humidifying operation.

As illustrated in FIG. 8, this flow begins with step G1 (hereinafter "step" is omitted where appropriate") where the controller 100 determines whether a capping command is received or not. Before the receipt of the capping command, the cap 41, i.e., the lip member 42, is located at the distant position.

When the capping command is received (G1: YES), the controller 100 at G2 drives the up/down motor 47 to bring the distal end of the lip member 42 into contact with the support face 5*a* of the platen 5, that is, the controller 100 drives the up/down motor 47 to move the lip member 42 from the distant position to the contact position. As a result, the ejection space S1 between the ejection face 1*a* and the support face 5*a* becomes the closed state in which the ejection space S1 is substantially isolated from the outside space S2 (see FIGS. 4 and 5B).

Upon completion of G2, the controller 100 at G3 drives the pump 56 for a predetermined length of time to perform the humidifying operation. In this operation, the humid air is supplied from the tank 54 into the ejection space S1 and then returns to the tank 54, so that humidity of the air in the ejection space S1 is adjusted to desired humidity. The ink in the humidification path (e.g., ink near the ejection openings 108 and residual ink) is replenished with water.

The capping and the humidifying maintenance thus end. Upon thereafter receiving a signal such as the recording command from the external device, the controller 100 drives the up/down motor 47 to move the distal end of the lip member 42 off the support face 5*a*, that is, the controller 100 drives the up/down motor 47 to move the lip member 42 from the contact position to the distant position. As a result, the ejection space S1 becomes the open state in which the ejection space S1 is open to the outside space S2 (see FIG. 1). The image forming operation is then performed under the control of the controller 100 as described above.

In the printer 101 according to the present embodiment as described above, when the humidifying operation is performed in the closed state, the humid air supplied from the crack 61 (as one example of the supply opening) flows along the inner circumferential face of the first region 42*a* of the lip member 42, then flows through the ejection space S1 between the ejection face 1*a* and the platen 5, and then flows along the inner circumferential face of the second region 42*b* of the lip member 42 which is opposed to the first region 42*a*. Thus, this printer 101 can reduce the increase in viscosity of the ink remaining on the lip member 42 and its vicinities. This can reduce the increase in viscosity of the ink in the ejection openings 108 in the closed state. In order to deliver the humid air along the inner circumferential face of the first region 42*a*, the crack 61 is preferably formed near the inner circumferential face and has a narrow (small) width, but this preferable form easily generates bubbles of the ink. If the diaphragm 43 comes into contact with the brim portion 38 when the ejection space S1 is switched to the closed state, and the humid air is supplied in this state, the bubbles are generated at the contact portions. However, the cutouts 38*a* of the brim portion 38 allow the humid air to be supplied into the ejection space S1 via the cutouts 38*a* without changing the path of the supplied humid air. That is, the humid air is not supplied through the contact portions. This design can suppress the generation of the bubbles upon the supply of the humid air, preventing the ejection face 1*a* from getting soiled. As a result, the ink ejection characteristics are stabilized.

Figure 9:
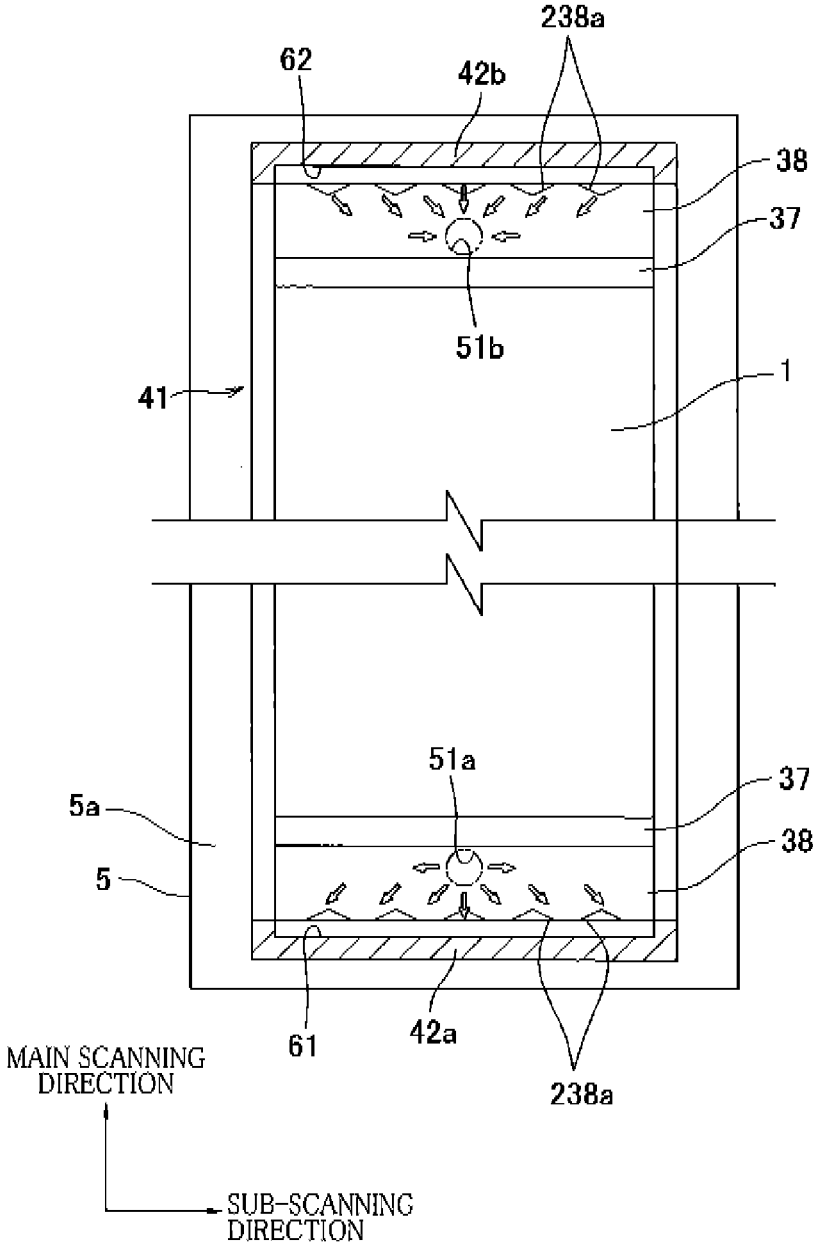
FIG. 9 is a view illustrating cutouts formed in brim portions in a modification.

As illustrated in FIG. 9, this printer may include cutouts 238*a* as a modification instead of the cutouts 38*a*. Each of these cutouts 238*a* has a V-shape (i.e., a triangle shape) when seen in the direction perpendicular to the ejection face 1*a*. Thus, in the case where the diaphragm 43 comes into contact with the outer edge portion of the brim portion 38 when the ejection space S1 is switched to the closed state, a film of the ink is not easily formed in the cutouts 238*a*. This is because, even when the ink is moved from the diaphragm 43 into the cutouts 238*a*, the ink is retained at corner portions of the cutouts 238*a* by surface tension of the ink. Thus, a film of the ink is less easily formed so as to cover the entire cutouts 238*a*, resulting in effective suppression of the generation of the bubbles.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, while each of the cutouts 38*a*, 238*a* has the rectangular shape or the V-shape in plan view in the above-described embodiment and the modification, each cutout may any shape. That is, as long as cutouts are formed in the outer edge portion of the brim portion 38, the generation of the bubbles can be suppressed. From the viewpoint of suppressing the generation of the bubbles, each cutout preferably has at least one corner portion. Also, in each of the cutouts 38*a*, the length in the sub-scanning direction, may be shorter than or equal to that in the main scanning direction. Also, the number of cutouts formed in the outer edge portion of each brim portion 38 is not limited to five and may be any other numbers greater than zero. Also, the tube 57 may be exposed to ambient air without being connected to the tank 54.

Also, the discharge opening for discharging the air from the ejection space S1 may be formed at any position, as long as the ejection face 1*a* is interposed between the discharge opening and the side face of the head 1 (i.e., the left side face of the head 1 in FIG. 4). For example, the discharge opening may be formed by a through hole formed in the brim portion 38. Also in this configuration, when the humidifying operation is performed in the closed state, the humid air supplied from the crack 61 (as one example of the supply opening) flows along the inner circumferential face of the first region 42*a* of the lip member 42 and then flows through the ejection space S1 between the ejection face 1*a* and the platen 5 to the discharge opening. This configuration can reduce the increase in viscosity of the ink remaining on the first region 42*a* of the lip member 42 and its vicinities. As a result, the viscosity of the ink in the ejection openings 108 does not easily increase in the closed state.

The present invention is applicable to any of a line printer and a serial printer and applicable not only to the printer but also to devices such as a facsimile machine and a copying machine. Also, the present invention is applicable to a liquid ejection apparatus configured to eject liquid other than the ink to perform the recording. The recording medium is not limited to the sheet P, and various recordable media may be used. The present invention may be applied to a liquid ejection apparatus of any ink ejection method. For example, the piezoelectric elements are used in the present embodiment, but various methods may be used such as a resistance heating method and an electrostatic capacity method.

What is claimed is:

1. A liquid ejection apparatus, comprising:

a head comprising an ejection face and configured to eject liquid through a plurality of ejection openings formed in the ejection face;

a capping mechanism comprising: a separator provided on the head and comprising a lip member enclosing the head; a facing member facing the ejection face to form an ejection space therebetween; and a lip-member moving mechanism configured to move the lip member between a contact position where the lip member is held in contact with the facing member and a distant position where the lip member is spaced apart from the facing member, the capping mechanism being configured to switch the ejection space between (i) a closed state in which the separator separates the ejection space and an outside space and (ii) an open state in which the ejection space is open to the outside space;

a humidifying mechanism comprising:

a humid air producer configured to produce humid air;

a first projecting portion extending along a first side face of the head and extending in a direction away from the first side face, the first projecting portion is disposed in the ejection space;

a supply opening defined by the first projecting portion and the separator, wherein the humid air produced by the humid air producer is supplied into the ejection space through the supply opening; and an air discharger disposed on an opposite side of the ejection face from the supply opening and configured to discharge air from the ejection space; and a controller configured to control the lip-member moving mechanism and the humidifying mechanism, wherein the separator comprises a flexible diaphragm configured to close a space formed between the lip member and the head, wherein the humidifying mechanism is configured to supply the humid air into a first space formed between the diaphragm and the first projecting portion, and wherein at least one cutout is formed in an edge portion, which faces the flexible diaphragm, of the first projecting portion, the at least one cutout being configured to allow humid air to be supplied into the election space in a state in which the lip member and the flexible diaphragm are in contact with the first protecting portion.

2. The liquid ejection apparatus according to claim 1, wherein the humidifying mechanism comprises a first coupler coupled to the first side face, and the diaphragm is coupled to the first coupler, the first coupler comprising an upper projecting portion extending in the direction away from the first side face, wherein the first projecting portion extends under the upper projecting portion in the direction away from the first side face, and wherein the first space is defined by the diaphragm, the first projecting portion, and the first coupler.

3. The liquid ejection apparatus according to claim 2, wherein the head comprises a second side face on an opposite side of the ejection face from the first side face, wherein the humidifying mechanism comprises: a second coupler which is coupled to the second side face and to which the diaphragm is coupled; and a second projecting portion extending under the second coupler in a direction away from the second side face, wherein the air discharger comprises a discharge opening defined by the second projecting portion and the diaphragm, and wherein at least one cutout is formed in an edge portion of the second projecting portion.

4. The liquid ejection apparatus according to claim 3, wherein the at least one cutout formed in the second projecting portion is configured to allow communication between the ejection space and a second space defined by the diaphragm, the second projecting portion, and the second coupler.

5. The liquid ejection apparatus according to claim 4, wherein the first coupler comprises a first channel configured to supply the humid air produced by the humid air producer into the first space, wherein the second coupler comprises a second channel configured to discharge air from the second space, and wherein the humidifying mechanism comprises: a first tubular passage that couples the humid air producer and the first channel with each other; and a pump configured to supply the humid air produced by the humid air producer into the first tubular passage.

6. The liquid ejection apparatus according to claim 5, wherein the humidifying mechanism further comprises a second tubular passage that couples the humid air producer and the second channel with each other, and wherein the humid air producer is configured to produce the humid air by humidifying air that is discharged from the second space and delivered via the second tubular passage.

7. The liquid ejection apparatus according to claim 1, wherein, when the ejection space is in the closed state, an entire lower face of the diaphragm is located above an upper face of the first projecting portion.

8. The liquid ejection apparatus according to claim 1, wherein each of the at least one cutout has a rectangular shape when seen in a direction perpendicular to the ejection face.

9. The liquid ejection apparatus according to claim 8, wherein a length of each of the at least one cutout in a direction in which the first projecting portion extends along the first side face is greater than a length of said each of the at least one cutout in the direction away from the first side face.

10. The liquid ejection apparatus according to claim 1, wherein each of the at least one cutout has a triangle shape when seen in a direction perpendicular to the ejection face.

11. The liquid ejection apparatus according to claim 1, wherein the at least one cutout is a plurality of cutouts.

12. The liquid ejection apparatus according to claim 11, wherein the plurality of cutouts are arranged in a direction along the first side face, and wherein, when the ejection space is in the closed state, a portion of the edge portion between each adjacent two of the plurality of cutouts is not in contact with the separator.

* * * * *